US009150291B2

(12) United States Patent
Dollar

(10) Patent No.: US 9,150,291 B2
(45) Date of Patent: Oct. 6, 2015

(54) WEIGHT DISTRIBUTION DEVICE AND METHOD FOR MODIFYING WAKE

(71) Applicant: Elliott B. Dollar, Port Neches, TX (US)

(72) Inventor: Elliott B. Dollar, Port Neches, TX (US)

( * ) Notice: Subject to any disclaimer, the term of this patent is extended or adjusted under 35 U.S.C. 154(b) by 0 days.

(21) Appl. No.: 14/162,333

(22) Filed: Jan. 23, 2014

(65) Prior Publication Data

US 2014/0202367 A1 Jul. 24, 2014

Related U.S. Application Data

(60) Provisional application No. 61/755,508, filed on Jan. 23, 2013.

(51) Int. Cl.

| | |
|---|---|
| ***B63B 43/08*** | (2006.01) |
| ***B63B 35/85*** | (2006.01) |
| *B63B 1/04* | (2006.01) |
| *B63B 35/73* | (2006.01) |

(52) U.S. Cl.

CPC ..... *B63B 43/08* (2013.01); *B63B 35/85* (2013.01); *B63B 2001/045* (2013.01); *B63B 2035/735* (2013.01); *B63B 2035/855* (2013.01)

(58) Field of Classification Search

CPC ..... B63B 43/08; B63B 35/85; B63B 39/02
USPC ..... 114/124
See application file for complete search history.

(56) References Cited

U.S. PATENT DOCUMENTS

| | | | | |
|---|---|---|---|---|
| 3,426,718 A * | 2/1969 | Webster et al. | ..... | 114/124 |
| 4,455,962 A * | 6/1984 | Gongwer | ..... | 114/124 |
| 6,349,660 B2 * | 2/2002 | Chaix | ..... | 114/124 |

* cited by examiner

*Primary Examiner* — Lars A Olson

(57) ABSTRACT

The present invention is a device mounted on a watercraft that creates a method of systematic weight distribution, which modifies a vessel's wake as it travels through water. The device uses systematically moveable ballast object(s) that are supported in a variety of positions along a specified path. As a ballast object is selectively moved towards a specific extremity of a watercraft, it causes that side or end to sink deeper in the water, and raises the opposing side or end, thus controlling or influencing the vessel's relative position on a body of water. When the watercraft is operating at higher speeds, the invention's ability to control the vessels' position allows an operator to selectively control the shape, size and slope of the watercraft's wake, as referenced in the disclosed method.

5 Claims, 10 Drawing Sheets

WEIGHT DISTRIBUTION DEVICE AND METHOD FOR MODIFYING WAKE

REFERENCES

| U.S. PATENT DOCUMENTS | | |
|---|---|---|
| 652,243 | June 1900 | Brown |
| 790,368 | September 1910 | Frahm |
| 1,730,941 | October 1929 | Myers |
| 1,853,069 | April 1932 | Minorsky |
| 2,916,232 | December 1959 | Schramm |
| 3,306,247 | February 1967 | Fanshawe |
| 3,397,664 | August 1968 | Slager |
| 3,604,386 | September 1971 | Cornaredo |
| 3,741,145 | June 1973 | Braddon |
| 3,842,777 | October 1974 | Larsh |
| 3,934,534 | January 1976 | Larsh |
| 6,044,788 A | April 2000 | Larson |
| 6,427,616 B1 | August 2002 | Hagen |
| 6,973,847 B2 | December 2005 | Adams |
| 7,140,318 B1 | November 2006 | Gasper |
| 7,240,630 B2 | July 2007 | Akers |
| 8,336,477 B2 | December 2012 | Walker |

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

FIELD OF INVENTION

The present invention generally relates to a systematically, conveniently and precisely maintaining a desired weight distribution level in a vessel. Although potentially beneficial in a multitude of non-marine industries, we'll describe the benefits of the invention through the water sport discipline of wakeboarding, where it is very important to maintain proper weight distribution within the watercraft pulling the wakeboarder. At higher speeds, generally above 15 mph, a wakeboard specific watercraft is designed to produce large, evenly shaped wakes that are used by a wakeboard rider to launch into the air, where he or she can perform various aerial maneuvers. Proper weight distribution from left to right or portside to starboard side—also considered roll, as well as front to back or bow to stern—also called pitch, create the desired conditions and proper wake shape for wakeboarding and other wake related sports. For example, another wake related discipline, wakesurfing, commonly uses a wakeboard specific watercraft to create a suitable wave for a rider to surf. These conditions also may be achieved my managing or modifying the weight distribution within a watercraft.

Currently, only non-efficient and inconvenient ways exist of distributing weight within water-sports specific watercrafts. One method is to ask passengers to shift around to different seating positions within the watercraft. This activity helps achieve the desired vessel position, regarding roll and pitch, but it is time consuming, inconvenient, frustrating and often inaccurate.

Often, watersports specific watercraft employ ballast systems that pump water in and out of stationary large containers, designed to create more water displacement, producing larger wakes when a watercraft is running at higher speeds. An example system is revealed in U.S. Pat. No. 6,427,616. These ballast capabilities provide another method of weight distribute within a watercraft, where the operator adjusts the water level in a specific stationary ballast container to help compensate for weight distribution needs. However, this method usually involves pumping water from a respective ballast tank, resulting in less vessel displacement, which has a minimizing effect on the wake size that counteracts the design purpose of a ballast system. However, the main drawback to this pumping method is the time consumption and inaccuracy. Considering the density of water, another issue is the space required within a vessel to employ a water container for weight distribution purposes. Some watercraft models might benefit from such a design, as in the case with large ships where space may not be as much of a concern. U-shaped tanks have previously been employed to dampen the roll movement of large ships at sea, as seen demonstrated by Frahm in U.S. Pat. No. 970,388. Some anti roll tanks have been equipped to actively and passively pump water back and forth to opposing sides of a U-shaped tank, which when selectively controlled, creates an anti-roll motion that further increases the efficiency and stability of a large ship at sea. The same principles are effective in a water sports watercraft but are usually less precise and more time consuming than the moveable ballast object method outlined by the preferred embodiment of the present invention. Although both methods offer stabilizing benefits to a watercraft the present invention proposes to modify a watercrafts' wake faster and with more precision, hence the stabilizing benefit is actually a by-product of the inventions' main wake shaping purpose. The previous art utilizing anti roll tanks for large ships could be scaled down to be applicable to a water sports specific watercraft, however the current ballast systems typically installed by boat manufacturers essentially already boast these capabilities. Even if a ballast system's pumping power was increased with respective piping and airflow, in order to accommodate the most efficient transfer of water ballast within a watercraft, it is still object of the present invention to perform the same benefit with more precision and with faster results. Because large ships only seek the stabilizing benefit of the anti roll tanks, water sports specific watercraft seem to benefit more from the ballast object method regarding the range of vessel sizes and the wake shaping benefit that is sought. In a water sports scenario, often it is important to incrementally distribute ballast, especially in the direction of portside to starboard side, in order to maintain a desired wake shape for water sports. Which, is accomplished best by the ballast object method, essentially abandoned by the ship industry on account of the vessel sizes and how much fixed weight would be required to arrive at the desired effect.

Another method employs manually placing weighted objects within the watercraft to achieve the desired vessel portion. This method can be inconvenient to the operator and passengers especial considering weight distribution needs are usually fluctuating between a variety of scenarios within a short period of time. Adding these extra weights to the watercraft can be inconvenient, not to mention dangerous, and manually moving them according to ever changing scenarios can be impractical and very inconvenient.

The invention apparatus creates an automatic method of moving both fixed and variably weighted ballast object(s) alongside assigned pathways, usually with electric motors, machinery or actuators, generally spanning in the directions of starboard-to-portside and/or bow-to-stern, ideally mounted above, below or within the vessel's deck or floor.

This is above the hull, but usually below the deck or floor of the boat as to not be seen by passengers. In some cases, models mounted above the deck or even outside the hull may be used to meet the same systematic weight distribution needs. In other cases, one may appreciate an embodiment of the present invention where stationary ballast objects in an existing ballast system, such as water tanks, may be configured for physical movement to meet weight distribution needs within a watercraft. These are all embodiments of a systematic weight distribution device designed to modify a watercraft's wake.

The invention apparatus, at the control of an operator or software program, is able to apply the gravitational force of one or more ballast object's mass to a specific place within a vessel, in a scenario when that force may be desired, in order to modify the relative position of the vessel, while on or traveling through a body of water. For example, as a passenger of a watercraft shifts toward the starboard side, the operator could send control impulses to the invention apparatus, which would then influence and allow one or more ballast object(s) to move toward the opposing portside of the watercraft and stop in a desired position. This action would help counterbalance the natural downward gravitational force of the passengers mass on the starboard side of the watercraft. The result is a more controllable, thus more reliable and safer vessel, which in effect increases the satisfaction and enjoyment for everyone using the watercraft, while also accurately shaping its wake for water sports when traveling through water. In U.S. Pat. No. 1,730,941, Myers employed a ballast object for the steadying of a large ship, but the present invention not only stabilizes a smaller watercraft designed for water sports, it most importantly provides a wake shaping benefit at increased speeds. In U.S. Pat. No. 652,243 Brown demonstrated the stabilizing effects of a moveable ballast for automatically counterbalancing the weight of the load handled by a crane, derrick or other like structure, which reduces its tendency to tip or overturn during operation. The aircraft industry benefited from Schramm's U.S. Pat. No. 2,916,232, which facilitates the movement of ballast cable between one drum located near the front of an aircraft and a second drum being located in the rear extremity of an aircraft. Further advantages of using a wake shaping device is demonstrated in Gasper's U.S. Pat. No. 7,140,318, which uses a water-foil that actively adjusts a watercraft's relative position, in order to modify the wake it produces while traveling through water. Walker's U.S. Pat. No. 8,338,477 uses a ballast object to hang beyond the sides of a boat in order to further heel the vessel towards the starboard or portside, which is intended to create a more suitable wave to surf at slower speeds.

BACKGROUND

In the sport of wakeboarding, there is an even-increasing need for a watercraft pulling a wakeboard rider to create larger and cleaner wakes for a rider to use to containers or adding people to a watercraft, which increases the amount of water a vessel displaces, and upon reaching a specific speed, a desired wake shape and size results. Generally, the more water a vessel displaces, the bigger its' will be while moving. At specific speeds, it is also equally important that a wake maintain a certain shape, slope and hardness in order to allow a rider to achieve a desired launch into the air. Ski-boat manufacturers have invested a lot of resources into creating specifically shaped watercraft hulls to produce certain shaped wakes while pulling skiers or wakeboarders. Many scenarios can affect the position of a watercraft pulling a performer on a body of water, but one of the most important variables, along with vessel speed and water displacement, is how weight/mass/cargo/passengers or ballast is distributed from within a vessel. Specifically, any downward force that influences the roll and pitch position of a watercraft while on a body of water, also influences the shape of the wake produced while the watercraft is moving. The present invention proposes a method to maintaining desired weight distribution levels within a vessel, (specifically, in a watercraft, both starboard-to-portside "roll" and bow-to-stern "pitch"). The invention apparatus and method will further provide more accurate wake and watercraft control for riders, drivers and passengers alike by using a method of systematic weight distribution in order to quickly shape a watercraft's wake.

In wakeboarding, it may be considered desirable to position weight differently according to many unique wafer sports scenarios. The invention apparatus and method creates an easier, more efficient and unique way to distribute or transfer weight or ballast within a vessel that is typically used for water sports. It's common for multiple people to be in a water sports specific watercraft, and it could be seen as valuable to have automatic capabilities to help counterbalance or enhance their natural gravitational force, which affects the watercrafts's roll and pitch position, while on a body of water. The present invention offers a systematic solution to these weight distribution needs.

Generally, the sport of wakeboarding requires an equally weighted tow boat, specifically starboard-to-portside, which provides balanced, clean wakes for a wakeboard rider, so he or she can achieve a consistent launch into the air. Proper bow-to-stern weight distribution may also affect the wake shape of a watercraft. In some instances, like in the sport of wakesurfing, the operator and passengers weight one side or end of the watercraft down more than the other to deliberately roll and pitch the watercraft to a desired position. In this weight distribution scenario, at slower speeds, the watercraft creates a suitable wave for a rider to surf. Although other methods of wakesurfing are known, it is usually time consuming or inconvenient to distribute ballast, cargo or passengers to arrive at the desired vessel position which creates a surfable wave. Using the invention apparatus while wakesurfing, the operator is able to quickly send one or more ballast object(s) to a specific area within a watercraft to aid in its arrival at a desired vessel position. This demonstrates the invention's ability to provide a greater degree of control over weight distribution needs, which is relevant to multiple wake-related water sports, including but not limited to: wakeboard, wakeskate, wakesurf, kneeboard, hydrofoil, slalom, trick, jump and barefoot-ski.

SUMMARY OF INVENTION

In view of the foregoing background, it is therefore an object of the present invention to improve the control of weight distribution in a vessel, specifically in order to enhance its wake at increased speeds. The general idea of the invention involves moving a fixed or variably weighted ballast object(s) with electric motor(s), actuator(s) or via other efficient means of controlled movement, selectively along a specified track within, or possibly outside of, a vessel. The system can be controlled and gauged manually, but one could also appreciate that automated features, instrumentation and software could be implemented for increased convenience and reliability. The weight distribution system provides benefit to a watercraft operator, passengers and water sports performer by helping control the roll and pitch position of a vessel, thus modifying its wake at increased speeds.

The present invention is designed to starboard-to-portside "roll", as well as bow-to-stern "pitch". Different vessels will respond better to respective ballast object dimensions and displacements, but generally the invention will provide a vessel benefit within these roll and pitch parameters. Some vessels may employ only a starboard-to-portside system, and possibly others may only use a bow-to-stern weight distribution system. Some vessels may employ a manually operated system, while some will benefit more with automated feature. One could also appreciate that some vessels could enjoy a combination of each of the above scenarios.

The preferred embodiment for the present invention is herein described, yet the description is not intended to limit the invention to the specifications of the preferred embodiment. However the details are to help explain the spirit and scope of the invention as to communicate its benefits in a multitude of water sports scenarios. An apparatus for maintaining weight distribution in a watercraft to modify its wake, may have a track, or other efficient method of transporting one or more mobile ballast object(s), spanning in the direction from one opposing end or side of the vessel to the other, configured for movement and selectively moveable by an operational controller. The track is what carries the majority of the downward gravitational fence of the ballast object's mass, which allows for the smooth transfer of its center of gravity, which then applies an affect on a watercraft's position. A fixed density or non-variable ballast object, including but not limited to lead or carbon steel, may have a wheel and axle system attached underneath it in order to facilitate its efficient movement in both directions along the specified track of movement. Preferably, the system may stop the ballast object at any location along the track of movement, as well as just before it comes in contact with either opposing end of the track. One could appreciate an embodiment of the design would include a manual over-ride option that allows the operator to manually direct the ballast object from a position, and place it into any desirable position, along its' track incase of any potential drive train failure. It could also be seen as valuable if the ballast object could be physically removed from the vessel for maintenance, storage and other general purposes.

DETAILED DESCRIPTION OF THE INVENTION

When beginning to describe the present invention, one will consider the vessel size in which the system will be installed, and choose an appropriate ballast object for the specific vessel application. Different vessels will respond better to varying ballast objects and their respective sizes and weights. In order to demonstrate the benefits and effectiveness of the invention, the preferred embodiment is described in reference to the attached drawings. The description of how to make and use this invention will be demonstrated through the preferred embodiment, but it is not intended to limit the invention so the embodiments described within. The invention includes alternatives, improvements and similar models, which may be reasonably considered within the spirit and scope of the invention.

Becoming familiar with certain terms is an important step in accurately describing and using the preferred embodiment of the invention. References will be made to nautical terms like: "portside", "starboard side", "bow", "stern", "roll" and "pitch" in order to describe the various positions of the invention's preferred embodiment relative to a watercraft, as demonstrated in the figures.

Referring to FIGS. 1A and 2A, one sees a diagram of a weight distribution system as well as a vessel or watercraft 21 demonstrating an example installation location where a system would be installed and used. Also displayed is an appropriate ballast object 1 regarding a respective size, shape and density for its vessel. The amount of ballast required will largely affect the size of the ballast object 1. Most applications will have space limitations, so typically the densest metals including, but not limited to lead, iron or carbon steel will provide the best solution for the ballast object 1 within a weight distribution system. This describes a fixed-weight embodiment of the design, meaning the ballast object's 1 mass may not be removed from the system without some form of physical removal and or potentially time consuming disassembly. This is the embodiment that we will focus on for the purposes of describing the system. An example of a variable-weight embodiment of the design could use a tank or container for the ballast object 1, where water would be pumped in and out, so the object could be heavier when desired and drained when not in use by the watercraft 21. As previously mentioned, an embodiment of the present invention could utilize the tanks in an existing ballast system by configuring them for movement along a specified track or pathway. These tanks tend to be large so space requirements are an issue, but the heavier the ballast object, essentially the less you have to move it to achieve a desired effect. In a typical ballast system there are two tanks toward the stern of the watercraft, usually one on the starboard side and one on the port side. These existing tanks could be configured to move independently as shown in FIG. 6A, but when moved in unison, they would have to travel less of a distance to achieve an effect on the watercraft's position. Basically, the more mass the present invention employs as a ballast object(s), the less it has to move the object(s) to achieve an affect on the vessel's position.

In FIG. 1A, there is a wheel and axle system 2 attached to the underside of the ballast object 1. This supports the downward gravitational force of the ballast object's 1 mass, and allows it to move freely in a desired direction along its specified track of movement 5. This feature may be optional for different embodiments of the invention, but the general purpose is to allow free motion of the ballast object 1 along its specified deck 5. A ballast object's 1 purpose is to carry enough downward gravitational force to influence vessel's 21 position according to an operator's needs. The downward force of the ballast object's 1 physical mass would interfere with the drive train of the design and the system would not mechanically operate if not supported in some way. The wheel and axle system 2 accomplishes this need for the preferred embodiment, but the ballast object's 1 mass could be supported via other reasonable means not described within.

The ballast object 1 is equipped for free movement along its specified track 5, the carrier mechanism 3, which connects the ballast object 1 to the lead screw 13 portion of the system, is attached to the ballast object 1 as referenced in FIG. 1A. The carrier mechanism 3 is attached to the ballast object 1 in order to facilitate its movement along its specified track 5. Different carrier mechanisms 3 may be used to suit varying applications. For the preferred embodiment, we permanently attached a threaded nut/carrier mechanism 3 to the ballast object, which threads with the lead screw 13 portion of the drivetrain. The builder must plan the exact location of where the carrier mechanism 3 is attached to the ballast object 1 in order for it to effectively align and thread with the threaded lead screw 13. Once perfectly aligned, a motor 9 connected to by a conventional chain and sprocket system 10, 11, 12 and 15 rotates the threaded lead screw 13 designed to work with the carrier mechanism 3 to guide the ballast object 1 into a desired location along its specified track 5. Basically the carrier mechanism 3, attached to the ballast object 1, will travel up and down the rotating lead screw 13, effectively placing the ballast object 1 within the watercraft 21 according to the operator's needs. Other means exist of moving the ballast object, but the threaded lead screw is efficient in that it quickly moves the ballast object to a position and also helps to hold or look it into that position. The correct lead screw thread pattern combined with the proper gearing ratio, turned by a specifically powered motor delivers a desired ballast object speed of movement. One could reasonably configure a rack-n-pinion system, actuator or series of belts, chains and/or pulleys to configure a ballast object for movement.

Once the ballast object 1 has been chosen and prepared, then some applications will require the construction of a frame 4, track or housing, or a combination of these, which will provide structure and guidance for the ballast object 1. The frame supports the ballast object 1 while its varying location is influenced along its controlled track of movement 5. Depending on the embodiment, this portion of the invention provides a backbone type function, which enhances the dependability and effectiveness of the weight distribution system. Different vessels 21 will have varying space requirements so the frame 4 will be built according to the specifications of each vessel 21.

The significant benefit of the present invention is that it offers quick and reliable weight distribution as per the specific needs of those using a vessel specifically a watercraft 21 designed for watersports. To do this, the system must be able to move a ballast object 1 to specific positions according to various scenarios as seen in FIGS. 3A through 4J. In order to put a ballast object 1 into motion, one will need to implement drivetrain components into the system's design. This will facilitate the efficient movement of the ballast object 1 along its specified track 5. Referring to FIG. 2D, the drivetrain for the preferred embodiment consists of a two-direction electrical motor 9 mounted inside a motor housing 7 connected to a motor plate 6 with bearing 14 via adjustable motor mounts 8. The system consists of a conventional chain 12 and sprockets 11 and 15, end plate 16 with bearing 17; threaded lead screw 13 and a threaded nut for a carrier mechanism 3. A moveable sled apparatus 38 may be designed to receive stackable ballast objects 37 as shown in FIG. 5A. This may allow for the easy removal of said ballast objects and allow the customization of the specific amount of ballast for a plurality of watercraft applications.

The motor housing 7 supports the motor 9, which powers the system. The motor housing 7 may be mounted to a motor plate 6, which is attached to the system's frame 4. The motor's shaft 10 must be machined or manufactured to fit a sprocket 11, gear or pulley that works with a chain 12 or belt-drive to rotate the threaded lead screw 13. The motor 9 is precisely mounted where its shaft 10 and gear 11 will line up such that it turns the chain 12 connected to the lead screw gear 15, conventionally connected to the lead screw 13, which is then able to rotate in a smooth-like manner. The motor 9 is adjustably mounted and supported within specified tolerances to help align the system's chain 12 drive or belt drive component. The adjustably mounted motor 8 will also allow an operator to maintain the chain 12 or belt's preferred level of tightness as if naturally wears over the course of normal use.

The motor plate 6 operationally mounted with a bearing 14, works as the mounting member for the motor 9 and motor housing 7, but it also houses and supports one end of the threaded lead screw 13. Different vessels 21 will require different sized systems, but generally the system will need to span a significant distance, specifically in the direction of portside 22 to starboard 23 or bow 24 to stern 26, in order to achieve the desired weight distribution effect of the strategically placed ballast object 1. The preferred embodiment of the design employs a threaded lead screw 13 spanning from a motor plate 6 to an end plate 16. The end plate 16 is attaches to the end of the frame 4 opposite of the motor 9. The motor plate 6 and end plate 16 are machined and aligned to house bearings 14 and 17 that cradle the threaded lead screw 13, and allow for its smooth rotation in both directions. Once the motor plate 6 and the end plate 16 have been fitted with bearings 14 and 17, then each plate may be attached to each end of the frame 4. Also, the threaded lead screw 13 needs to be machined on one end to support a sprocket 15, gear or pulley. One could employ conventional key-way system to connect the gear 15 to the lead screw 13.

With both the motor plate 6 and end plate 16 in place, and the ballast object 1 within it's specified track of movement 5, one will thread the non-machined end of the threaded lead screw 13 through the motor plate 6 and bearing 14, through the carrier mechanism 3 that is attached to the ballast object 1, then finally through the bearing 17 in the end plate 16. It is now apparent why significant attention to detail is required when mounting the carrier mechanism 3 to the ballast object 1 to ensure if aligns with the respective threaded lead screw 13 or other efficient drivetrain component. Once installed, the machined end of the lead screw 13 should protrude enough from the outside of the motor plate 6 and bearing 14 to mount a sprocket 15, gear or pulley. The sprocket 15 is attached to the threaded lead screw 13 such that if will perfectly align with the gear 11 on the motor shaft 10. The sprockets 11 and 15 are connected by a chain 12 or belt that controls the direction and rate of movement of the threaded lead screw 13.

A control mechanism 19 is needed to send electrical impulses to the system's motor 9 in order to direct the movement of the ballast object 1. The preferred embodiment of the invention employs a 12-volt DC motor 9 that operationally connects a two-direction controller 19 to a standard automotive battery 18 with wire 20. The control mechanism 19 allows the operator to send the ballast object 1 to any position within the system's frame 4 or specified track of movement 5. A forward and reverse control commend will allow the user to place the ballast object 1 according to specific needs. The control mechanism 19 could also allow the operator to power-off the system or change to different modes depending on the complexity and design capabilities. It could be valuable to incorporate instrumentation and software into an embodiment of the system, that not only reads and communicates the position of the ballast object 1, but also automatically controls its position according to different settings or scenarios as shown in FIGS. 3A through 4J.

With the components aligned and assembled, the motor 8 can rotate the threaded lead screw 13 in two opposing directions causing the carrier mechanism 3 that is attached to the ballast object 1 to travel along its specified track 5. Since the ballast object 1 represents an increased amount of physical mass, as it efficiently travels along its specified track 5 the result is systematic weight distribution, which can accurately and efficiently influence the position of a vessel 21 on a body of water, thus rendering a shaping effect on the watercraft's wake at increased speeds.

BRIEF DESCRIPTION OF THE DRAWINGS

FIG. 3 labels the system components represented throughout FIG. 3A-FIG. 3J.

FIG. 4 labels the system components represented throughout FIG. 4A-FIG. 4J.

Figure 1A:
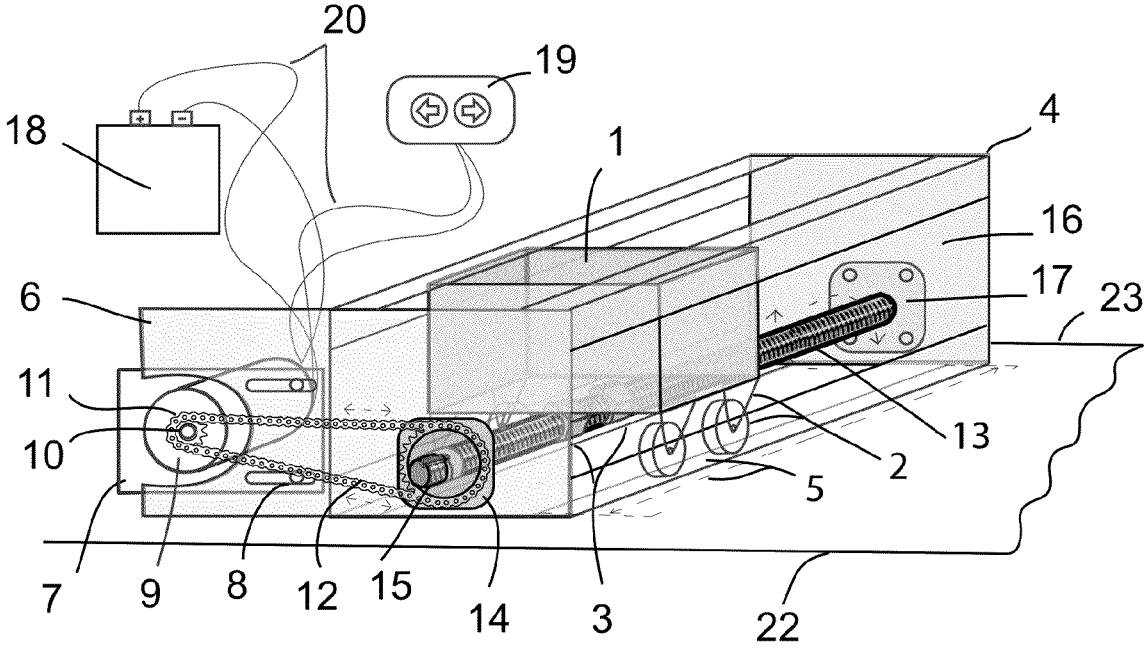
FIG. 1A is a perspective view of a systematic weight distribution system shown in a preferred embodiment, resting on a flat surface, spanning from portside to starboard side within a watercraft.
Figure 1B:
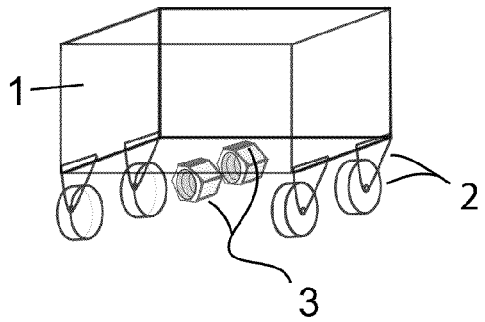
FIG. 1B is a basic view of a ballast object equipped for movement.
Figure 1C:
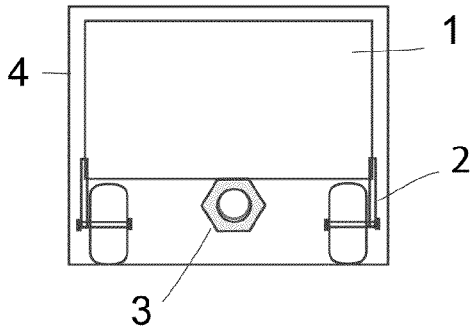
FIG. 1C is a side view of a ballast object within a frame equipped for movement.
Figure 2A:
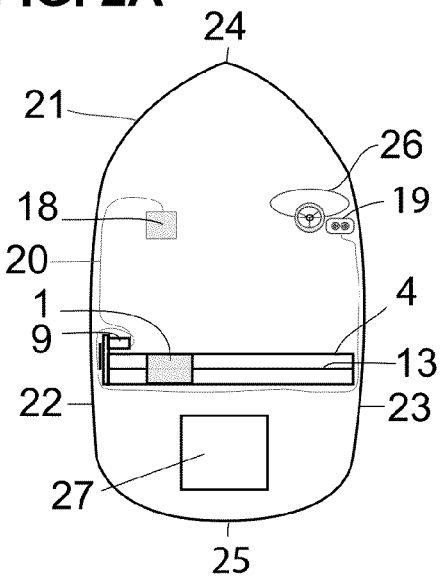
FIG. 2A is a top view of a typical watercraft demonstrating a general location and design schematic for a weight distribution system.
Figure 2B:
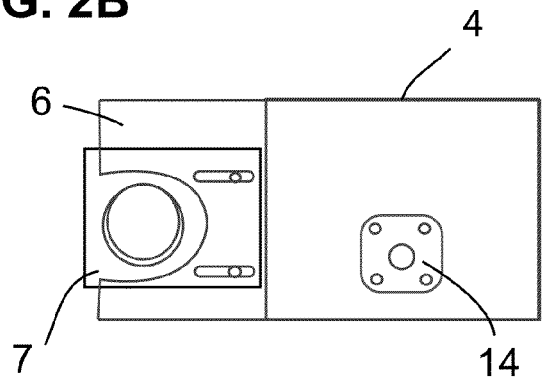
FIG. 2B is an end view of a preferred embodiment of the motor end of a system's frame.
Figure 2C:
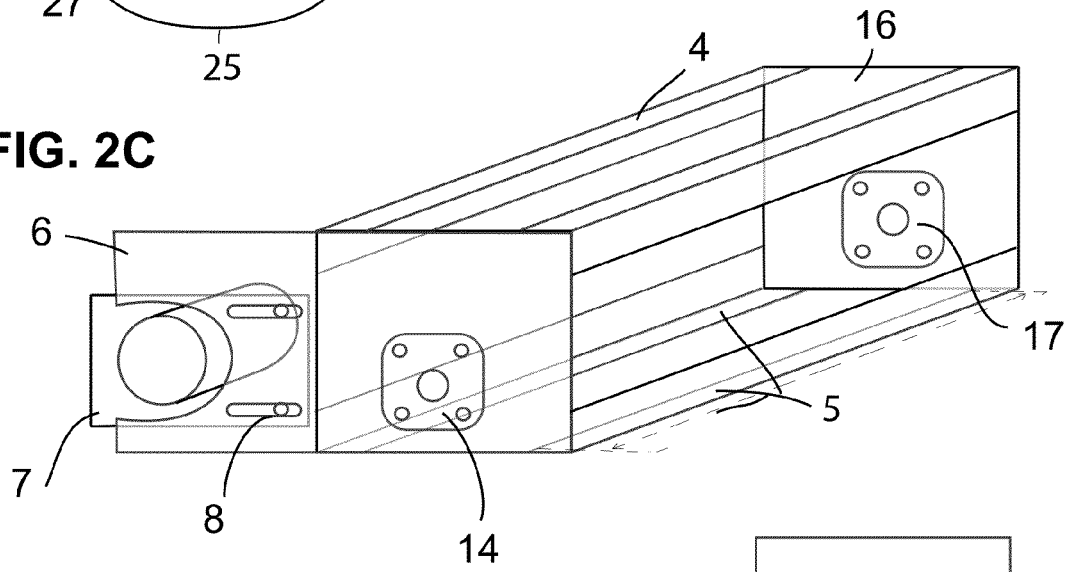
FIG. 2C outlines the support structure or frame for a weight distribution system.
Figure 2D:
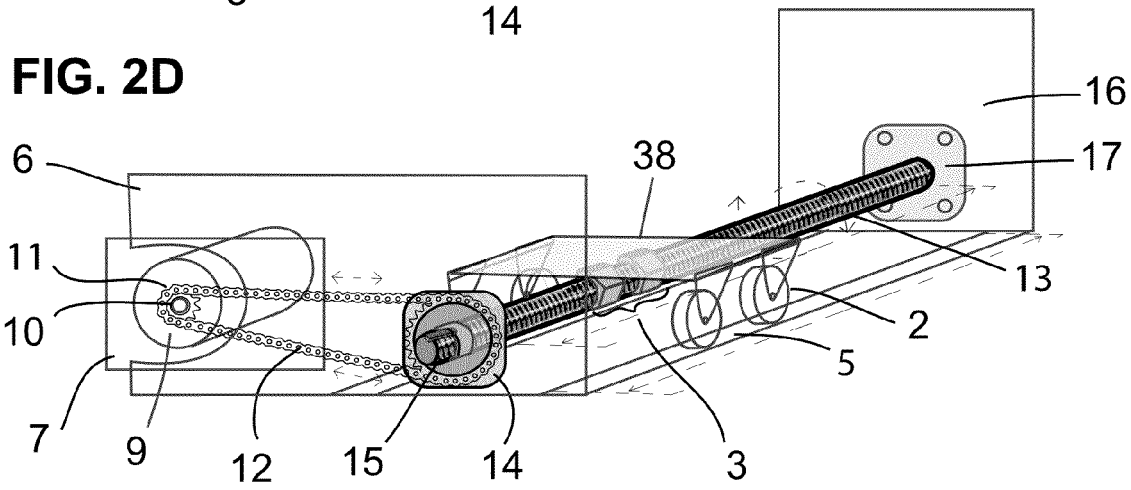
FIG. 2D displays drivetrain components of a preferred embodiment of the invention, which allows a ballast object to be set in motion and placed in a plurality of positions.
Figure 3:
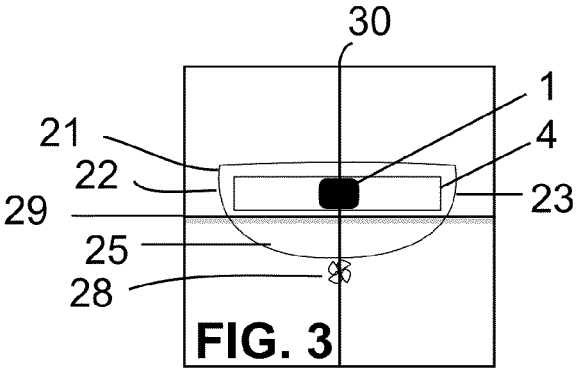
FIG. 3, depicts a rear view of a vessel 21 or a view of its stern 25, while on a body of water represented by the X-axis 29, as well as a representation of a frame 4 of the preferred embodiment of the invention operating within a watercraft 21. The ballast object's 1 movement parameter are any position within the frame 4 spanning from the portside 22 to the starboard side 23 of a watercraft 21. The stern 25 of the watercraft 21 and the propeller 28 are shown below the water line or X-axis 29 representing a body of water. The figure is designed with an X-axis 29 and a Y-axis 30 to show incremental changes in a watercraft's 21 relative position, while being influenced by the system's ballast object 1 during various scenarios.
Figure 3A:
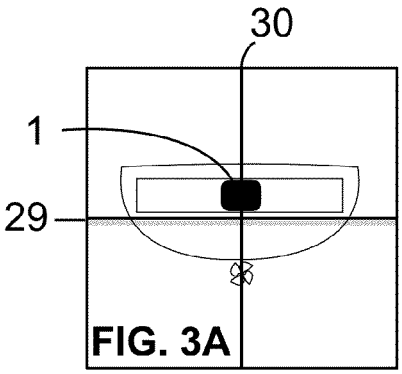
FIG. 3A, shows the ballast object 1 positioned directly on the Y-axis 30. This is a representation of a balanced watercraft 21 relative to the water line or X-axis 29.
Figure 3D:
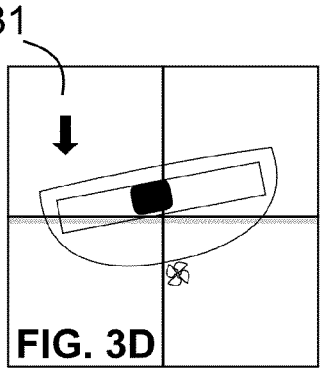
FIG. 3D, displays the ballast object 1 positioned in the center of a watercraft 21 and on the Y-axis 30. This figure represents a portside-heavy watercraft 21 caused by a downward force 31 on the portside 22. This is a representation of a watercraft 21 with an un-evenly distributed payload rolling to the portside 22.
Figure 3G:
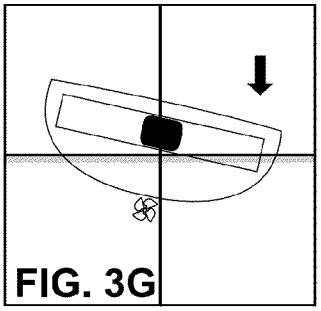
FIG. 3G, displays the ballast object 1 positioned in the center of a watercraft 21 and on the Y-axis 30. This figure represents a starboard-side heavy watercraft 21 caused by a downward force 31 on the starboard side 23. This is a representation of a watercraft 21 with an un-evenly distributed payload rolling to the starboard side 23.
Figure 3B:
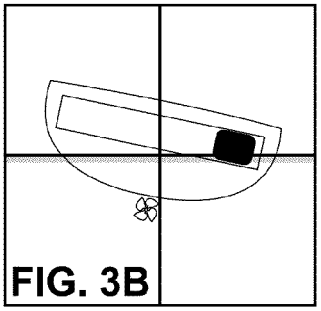
FIG. 3B, shows the ballast object 1 positioned completely to the starboard side 23. Notice the propeller 28 moving to the left of the Y-axis 30. This is a representation of rolling a watercraft 21 to the starboard side 23.
Figure 3E:
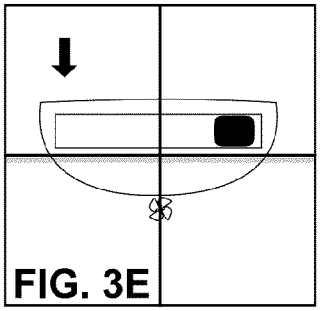
FIG. 3E, shows the ballast object 1 now positioned fully to the starboard side 23 of a watercraft 21, which is now level on the X-axis 29 demonstrating the counterbalancing effects the ballast object 1 has on a vessel's 21 position regarding the natural effects of the downward force 31 on the starboard side 23.
Figure 3H:
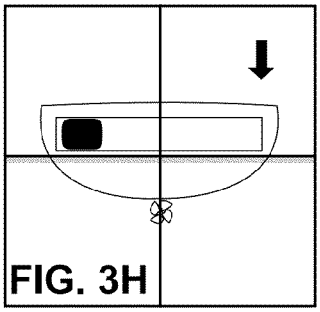
FIG. 3H, shows the ballast object 1 located fully to the portside 22 of the watercraft 21, which is now level on the X-axis 28 demonstrating the counterbalancing effects the ballast object 1 has on a vessel's 21 position regarding the effects of the downward force 31 on the starboard side 23.
Figure 3C:
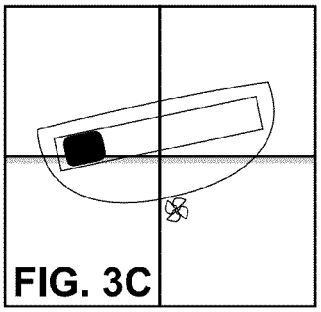
FIG. 3C, displays the ballast object 1 positioned fully to the portside 22 of a watercraft 21. Notice the propeller 28, now fully to the right of the Y-axis 30. This is a representation of rolling a watercraft 21 to the portside 22.
Figure 3F:
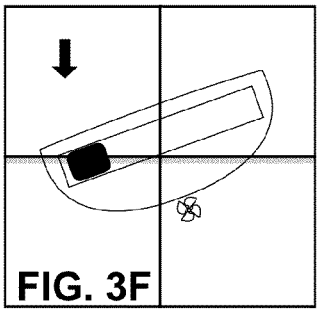
FIG. 3F, shows a scenario where downward force 31 is on the portside 22 of a watercraft 21, and the ballast object 1 being positioned completely to the portside 22 demonstrating a combined effect further rolling a watercraft 21 to the portside 22. Notice the propeller 28 even further away from the Y-axis 30 as compared to FIG. 3C.
Figure 3J:
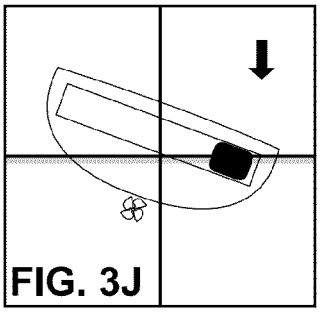
FIG. 3J, also shows a scenario where downward force 31 is on the starboard side 23 of a watercraft 21 and the ballast object 1 being positioned completely to the starboard side 23 demonstrating a combined effect further rolling a watercraft 21 to the starboard side 23. Notice the propeller 23 even further away from the Y-axis 30 as compared to FIG. 3B.
Figure 4:
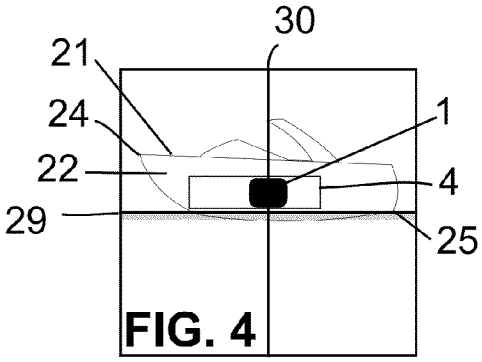
FIG. 4, depicts a side view of a vessel 21 facing the portside 22, while on a body of water represented by the X-axis 29, as well as a representation of a frame 4 of the preferred embodiment of the invention operating within a watercraft 21. The ballast object's 1 movement parameters are any position within the frame 4 spanning from the bow 24 to the stern end 23 of the system within a watercraft 21. The figures are designed with an X-axis 29 and a Y-axis 30 to show incremental changes in a watercraft's 21 position, while being influenced by the system's ballast object 1 during various scenarios.
Figure 4A:
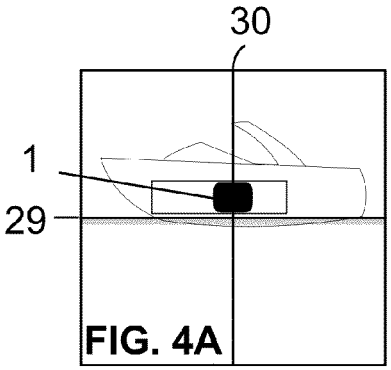
FIG. 4A, shows the ballast object 1 positioned directly on the Y-axis 30. This is a representation of a balanced watercraft 21 relative so the water line or X-axis 29.
Figure 4D:
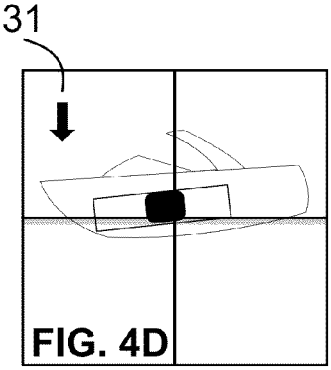
FIG. 4D, displays the ballast object 1 positioned in the center of a watercraft 21 and on the Y-axis 30. This figure represents a bow-heavy watercraft 21 caused by a downward force 31 on its bow 24. This is a representation of a watercraft 21 with an un-evenly distributed payload pitching towards the bow 24.
Figure 4G:
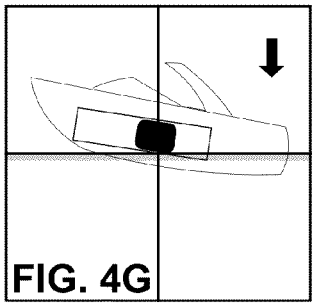
FIG. 4G, displays the ballast object 1 positioned in the center of a watercraft 21 and on the Y-axis 30. This figure represents a stern-heavy watercraft 21 caused by a downward force 31 on the stern end 25. This is a representation of a watercraft 21 with an un-evenly distributed payload pitching toward the stern end 25.
Figure 4B:
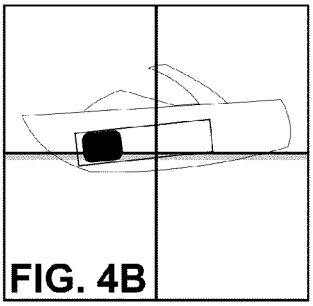
FIG. 4B, shows the ballast object 1 positioned completely towards the bow 24 within a watercraft 21. This is a representation of pitching a watercraft 21 so its bow 23 rides deeper in the wafer.
Figure 4E:
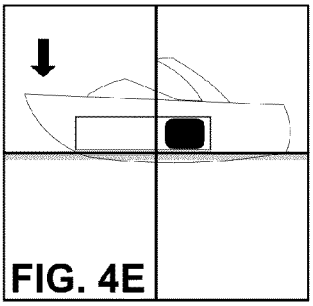
FIG. 4E, shows the ballast object 1 now positioned fully to the stern end 25 of a watercraft 21, which is now level on the X-axis 29 demonstrating the counterbalancing effects the ballast object 1 has on a vessel's 21 position regarding the natural effects of the downward force 31 on the bow 24.
Figure 4H:
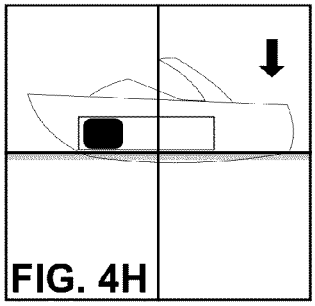
FIG. 4H, shows the ballast object 1 located fully towards the bow 24 of the watercraft 21, which is now level on the X-axis 29 demonstrating the counterbalancing effects the ballast object's 1 has on a vessel's 21 position, regarding the natural effects of any downward force 31 on the stern end 25.
Figure 4C:
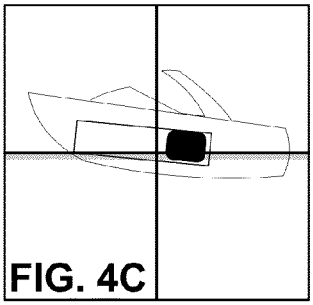
FIG. 4C, displays the ballast object 1 positioned fully towards the stern end 25 of a watercraft 21. This is a representation of pitching a watercraft 21 so its stern 23 rides deeper in the water.
Figure 4F:
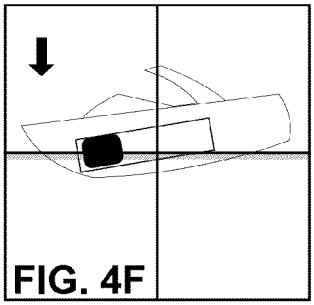
FIG. 4F, shows a scenario where downward force 31 is on the bow 24 of a watercraft 21, and the ballast object 1 being positioned completely towards the bow 24 demonstrating a combined effect further pitching a watercraft 21 toward the bow 24.
Figure 4J:
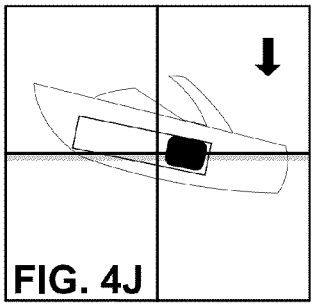
FIG. 4J, also shows a scenario where downward force 31 is on the stern end 25 of a watercraft 21, and the ballast object 1 being positioned completely towards the stern end 25 demonstrating a combined effect further pitching a watercraft 21 toward the stern end 25.
Figure 5A:
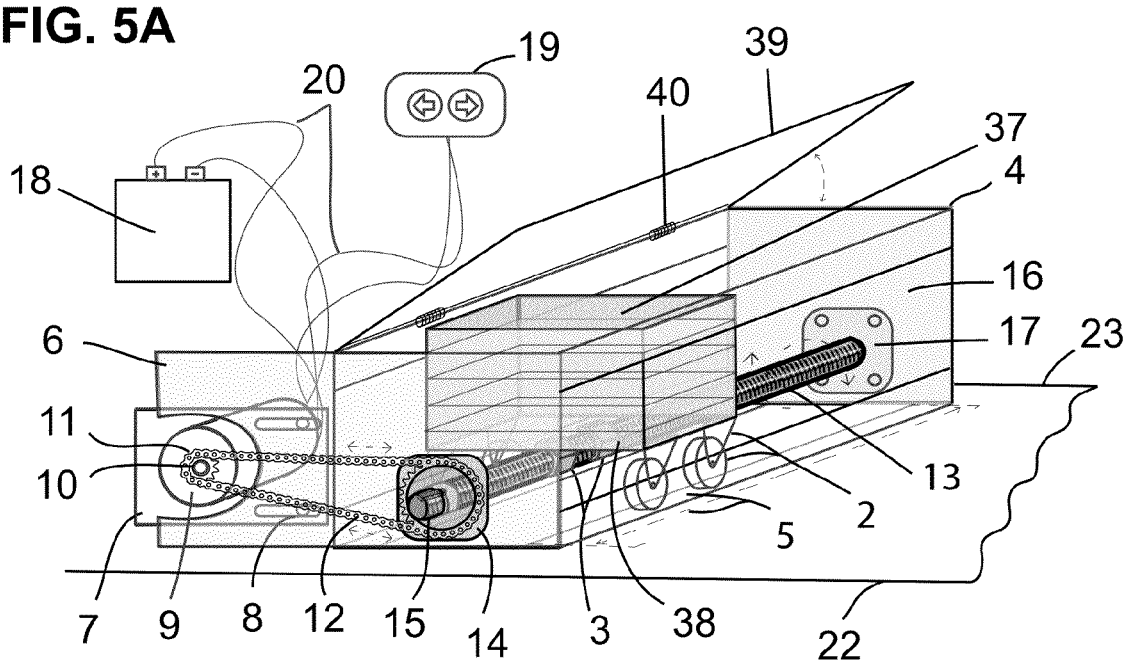
FIG. 5A is a perspective view of a systematic weight distribution system shown in a preferred embodiment, resting on a flat surface, spanning from portside to starboard side within a watercraft. This embodiment shows a top lid 38 that attaches to the system's frame via conventional hinges 40, which allows access to the ballast object or drivetrain for maintenance.
Figure 5B:
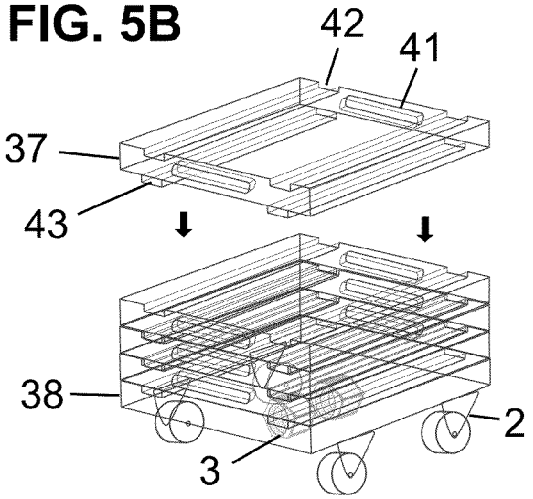
FIG. 5B is a basic view of a moving sled apparatus 38 loaded with multiple stackable ballast objects 37 that consist of molded lifting tabs 41 with female stacking grooves 42 which receive a male stacking groove 43 of an accompanying stackable ballast object such that the movement of said objects is secured and restricted from unwanted shifting during use or storage.
Figure 5C:
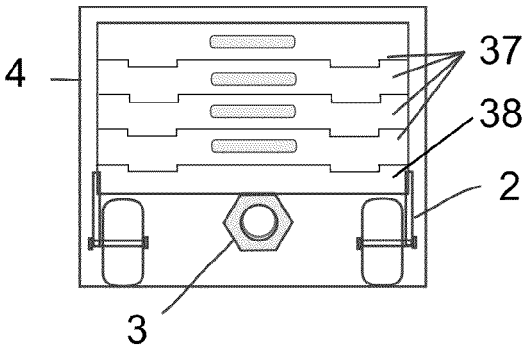
FIG. 5C is a side view of stackable ballast objects 37 loaded onto a movable sled apparatus 38 within a frame equipped for movement.
Figure 6A:
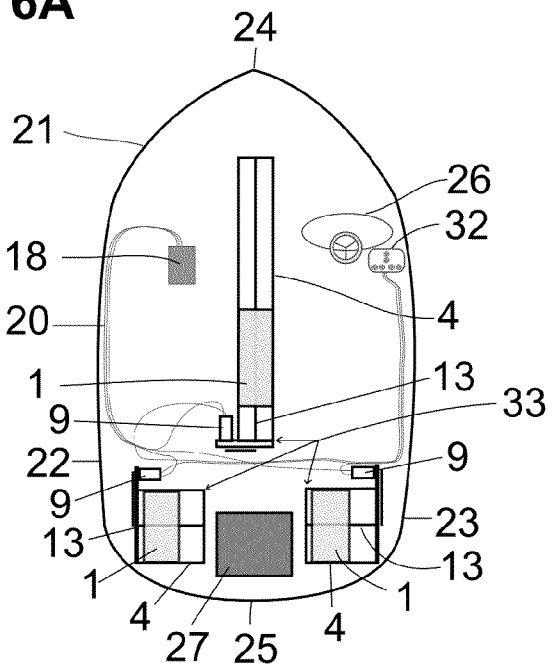
FIG. 6A-FIG. 6C is a top view of a watercraft demonstrating multiple weight distribution systems mounted within the watercraft and a plurality of positions for each ballast object.
Figure 6B:
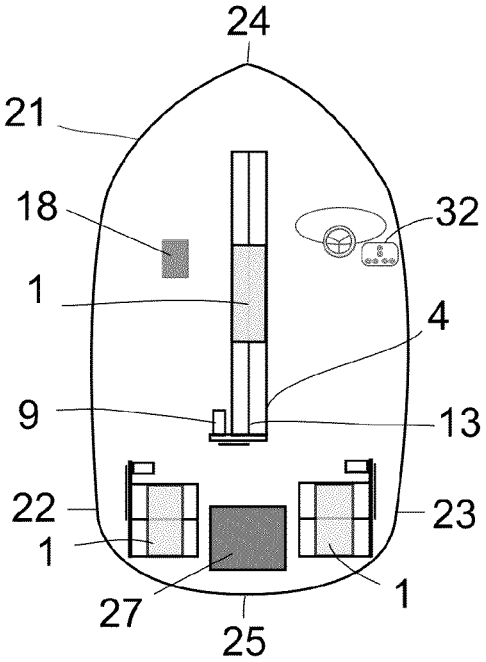
Figure 6C:
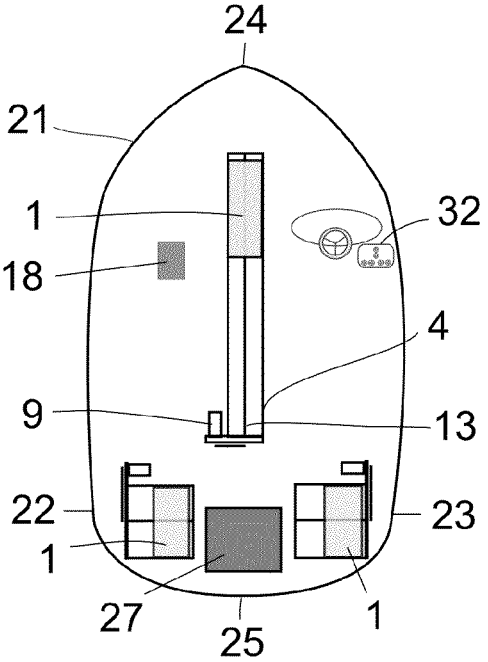
Figure 7A:
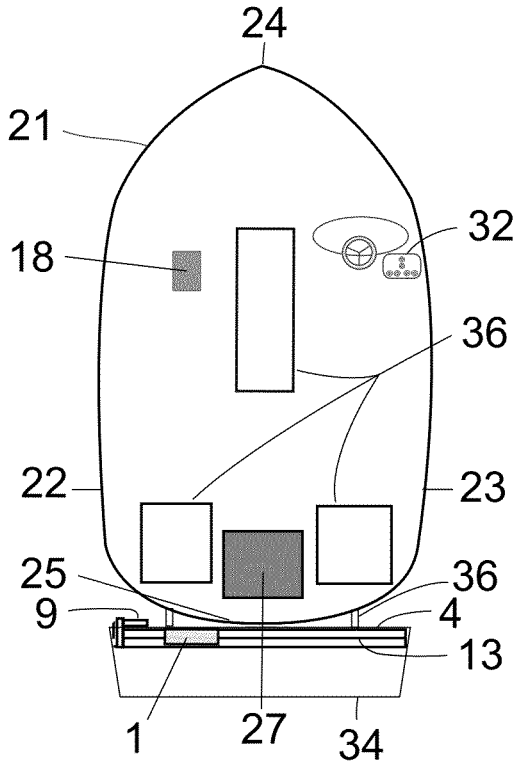
FIG. 7A is a top view of a watercraft demonstrating a weight attribution system being mounted on a typical swim step of an inboard ski boat.
Figure 7B:
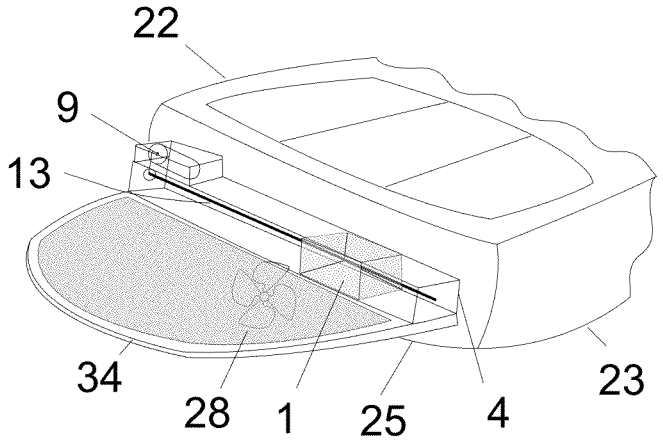
FIG. 7B is a partial view of a watercraft's stern end 25 demonstrating a possible install location for a weight distribution system that is mounted on a typical swim step of an inboard ski boat. It's important to note that no direct interaction with the water is required with the present invention. Managing the weight distribution is the element that shapes the watercraft's wake.
Figure 8A:
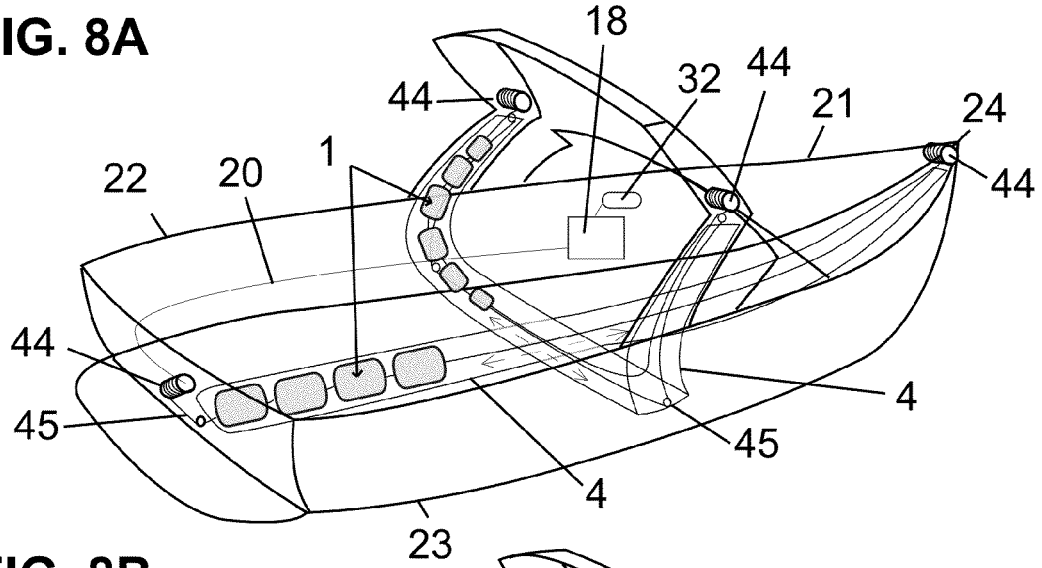
FIG. 8A is a perspective view of another preferred embodiment of the present invention installed in a watercraft. The ballast object 1 is sectioned such that it may bend or flex as it travels along the curvature of the boat's hull design. There are ballast objects 1 that travel portside 22 to starboard 23 and from bow 24 to stern 25. An arrangement of cables and pulleys operationally connected to a motor and cable spool is what drives the ballast objects in this embodiment. A controller connected to a power source allows an operator to selective position the ballast objects within their frames 4.
Figure 8B:
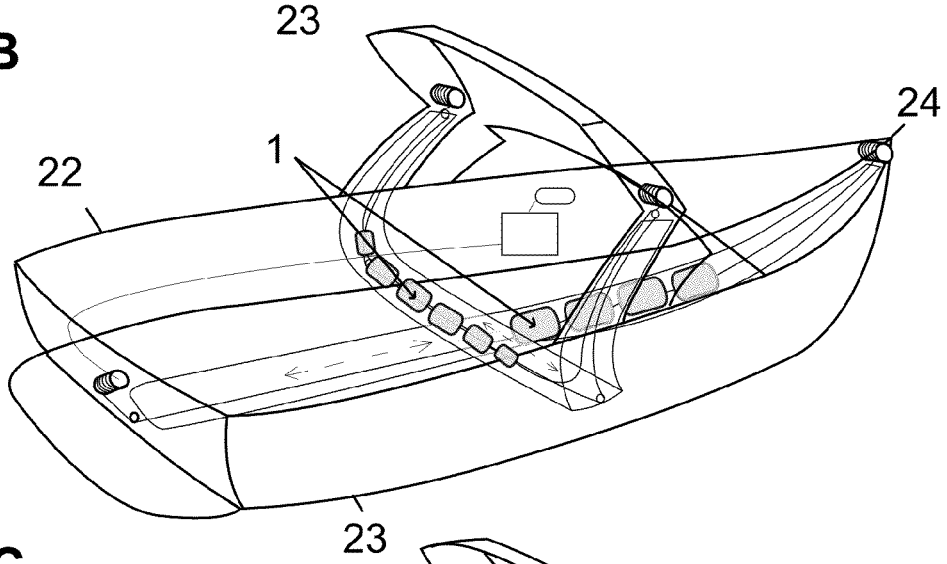
FIG. 8B is the same perspective view as FIG. 8A, however the ballast objects 1 have been moved more to the center of the watercraft to demonstrate their specified paths of movement.
Figure 8C:
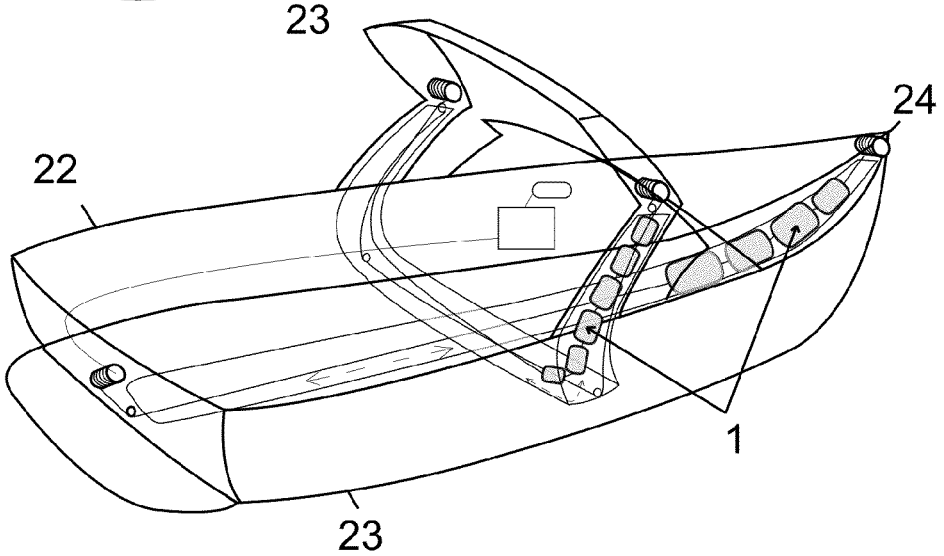
FIG. 8C demonstrates the ballast objects located in the opposite configuration of FIG. 8A. The ability of the invention to allow the ballast objects to travel along the curvature of the boat and up the sides, possibly even into the boats towing apparatus or tower, allows the system to increase it's effectiveness by placing more weight at the furthest extremity without going beyond the watercraft's sides.
Figure 9A:
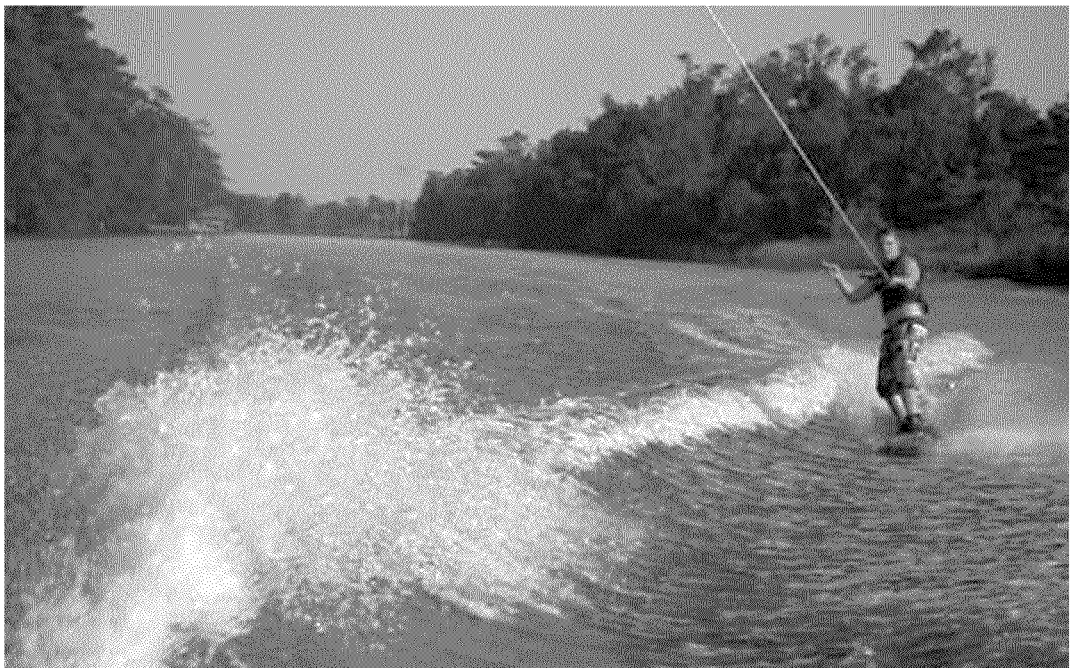
FIG. 9A shows a view of an unbalanced or washy portside wake produced by a watercraft that is towing a wakeboarder.
Figure 9B:
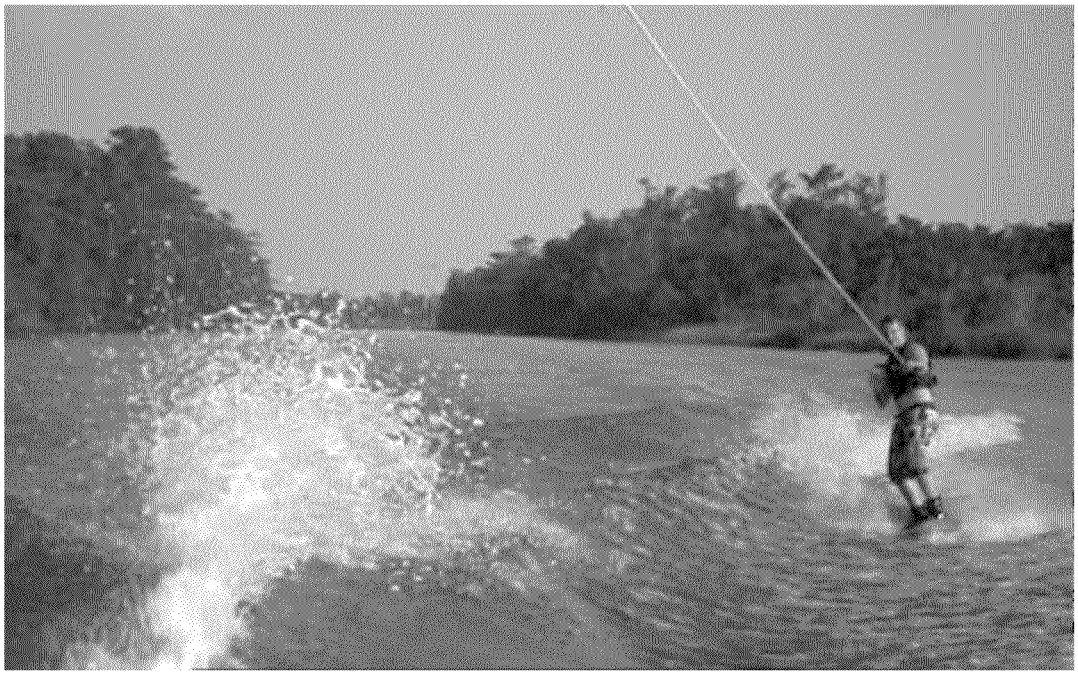
FIG. 9B shows a view of a balanced or clean portside wake produced by a watercraft that is towing a wakeboarder. This scenario is preferred in wakeboarding as it allows the rider to execute a more predictable jump when using the wake to perform tricks or maneuvers.
Figure 10A:
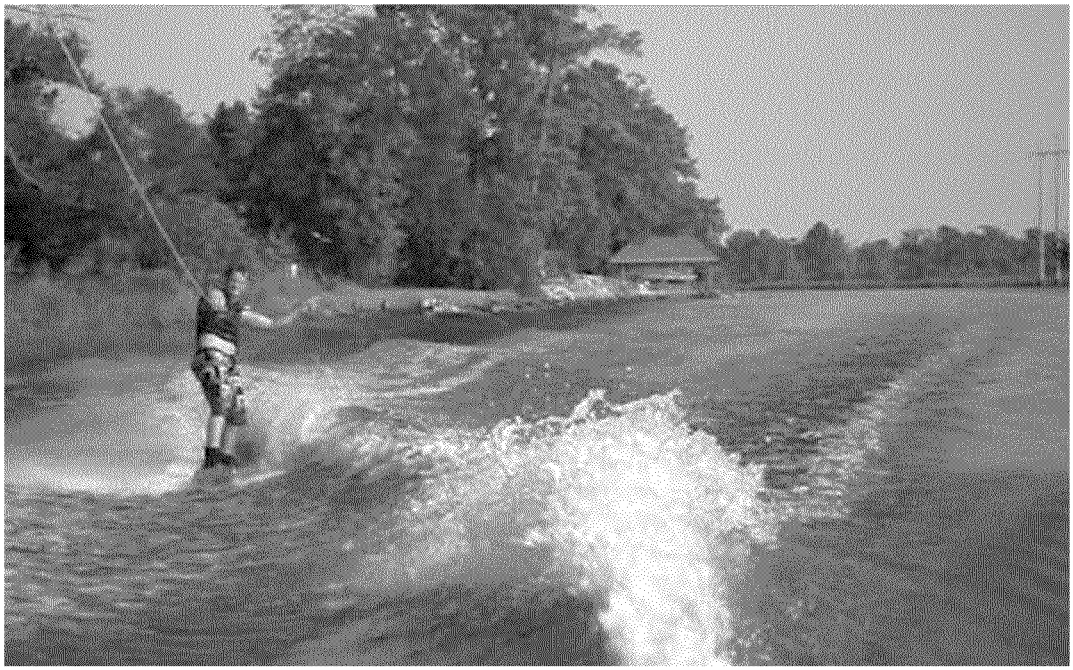
FIG. 10A shows a view of an unbalanced or washy starboard wake produced by a watercraft that is towing a wakeboarder.
Figure 10B:
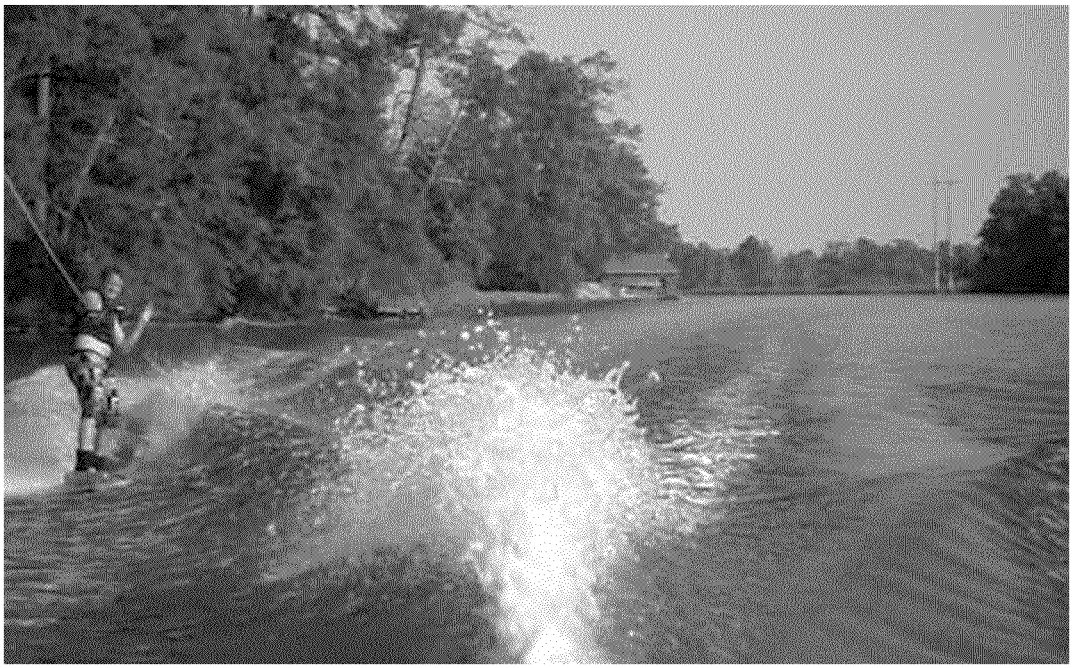
FIG. 10B shows a view of a balanced or clean starboard wake produced by a watercraft that is towing a wakeboarder. This scenario is preferred in wakeboarding as it creates a more suitable wake to jump in order for a rider to perform various aerial maneuvers.

What is claimed is:

1. A weight distribution system for shaping wakes produced by a watercraft traveling through water, the system comprising:

at least one ballast object specifically designed and configured for the selective movement and placement of its center of gravity along a specified path, thereby modifying the relative position of the watercraft rendering a modifying effect on the shape, slope and symmetry of said wakes produced by the watercraft traveling through water;

a frame, track or housing mounted transversely to the transom of a watercraft that provides structural support along the ballast object's specified path of movement;

a power mechanism capable of selectively moving a ballast object into a plurality of positions along its specified path;

a drivetrain system operationally connected to a power mechanism which guides and facilitates the selective movement of said ballast object;

a linkage connecting the ballast object to a drivetrain system which allows the ballast object to move along its specified path;

a controller for selectively engaging the power mechanism to interact with a drivetrain system therefore selectively moving the connected ballast object back and forth along its specified path.

2. The weight distribution system of claim 1 and the combination of a watercraft having a longitudinal centerline and a ballast system comprising at least one moveable ballast object and means for selectively moving said ballast object back and forth across said longitudinal centerline in order to modify the shape, slope and symmetry of the watercraft's wake.

3. The weight distribution system of claim 1 and the combination of a watercraft having a latitudinal centerline and a ballast system comprising at least one moveable ballast object and means for selectively moving said ballast object back and forth across said latitudinal centerline in order to modify the shape, slope and symmetry of the watercraft's wake.

4. The weight distribution system of claim 1 comprising a power mechanism operationally connected to rotate a lead screw, which guides and facilitates the selective movement of said ballast object that is attached to a threaded nut which travels back and forth along said lead screw.

5. The weight distribution system of claim 1 comprising a power mechanism operationally connected to an arrangement of cables and pulleys, which guides and facilitates the selective movement of said ballast object that is connected to said cable which is configured to run parallel with said path of movement.

* * * * *